US008677966B2

(12) United States Patent
Niakan

(10) Patent No.: US 8,677,966 B2
(45) Date of Patent: Mar. 25, 2014

(54) AIR INTAKE FLOW DEVICE AND SYSTEM

(75) Inventor: Shahriar Nick Niakan, Anaheim Hills, CA (US)

(73) Assignee: Advanced Flow Engineering, Inc., Corona, CA (US)

( * ) Notice: Subject to any disclaimer, the term of this patent is extended or adjusted under 35 U.S.C. 154(b) by 397 days.

(21) Appl. No.: 13/010,748

(22) Filed: Jan. 20, 2011

(65) Prior Publication Data

US 2012/0186552 A1 Jul. 26, 2012

(51) Int. Cl.
*F02M 35/10* (2006.01)

(52) U.S. Cl.
USPC ..... 123/184.21; 60/599; 285/397

(58) Field of Classification Search
USPC ..... 123/184.21–184.61, 198 E, 559.1, 562, 123/565; 285/364, 305, 308, 309, 382, 285/382.1, 382.2, 336–337, 343, 377, 397; 277/313–316; 60/599
See application file for complete search history.

(56) References Cited

U.S. PATENT DOCUMENTS

| | | | | |
|---|---|---|---|---|
| 2,598,603 | A | | 5/1952 | Richtarsic |
| 3,090,490 | A | | 5/1963 | Yocum |
| 3,186,552 | A | | 6/1965 | Cutler |
| 3,236,543 | A | * | 2/1966 | Mueller ..... 285/2 |
| 3,290,870 | A | | 12/1966 | Jensen |
| 3,307,337 | A | | 3/1967 | Freitas, Jr. et al. |
| 3,399,516 | A | | 9/1968 | Hough, Jr. et al. |
| 3,400,520 | A | | 9/1968 | Sakurai |
| 3,572,013 | A | | 3/1971 | Hansen |
| 3,572,014 | A | | 3/1971 | Hansen |
| 3,679,239 | A | * | 7/1972 | Schmitt ..... 285/148.22 |
| 3,747,303 | A | | 7/1973 | Jordan |
| 3,934,992 | A | | 1/1976 | Thompson |
| 4,014,796 | A | | 3/1977 | Sugiyama et al. |
| 4,197,100 | A | | 4/1980 | Hausheer |
| 4,233,043 | A | | 11/1980 | Catterson |
| 4,251,238 | A | | 2/1981 | Claes et al. |
| 4,257,791 | A | | 3/1981 | Wald |
| 4,259,096 | A | | 3/1981 | Nakamura et al. |
| 4,279,630 | A | | 7/1981 | Nakamura et al. |
| 4,314,832 | A | | 2/1982 | Fox |
| 4,322,230 | A | | 3/1982 | Schoen et al. |
| 4,323,374 | A | | 4/1982 | Shinagawa et al. |
| 4,349,363 | A | | 9/1982 | Patel et al. |
| 4,440,555 | A | | 4/1984 | Chichester |
| 4,595,401 | A | | 6/1986 | Witchell |
| 4,610,705 | A | | 9/1986 | Sarnosky et al. |
| 4,623,365 | A | | 11/1986 | Bergman |
| 4,632,682 | A | | 12/1986 | Erdmannsdorfer |
| 4,728,349 | A | | 3/1988 | Oshitari |

(Continued)

*Primary Examiner* — Hung Q Nguyen
(74) *Attorney, Agent, or Firm* — WHGC, P.L.C.; John P. O'Rourke

(57) ABSTRACT

An intake flow device and system for coupling a turbocharger's compressor intake to an air intake is disclosed. The flow device may be cylindrically shaped, flexible, and configured to fit on an intake flange of the compressor. An intake conduit may be fitted around the flow device, such that the intake conduit may retain a large diameter for increased air flow, rather than necking down to mate with the intake flange. The flow device may incorporate compression ribs around its outer circumference for positively mating with the air intake conduit and may incorporate a recess within its interior for securely mating to a lip on the intake flange. The flow device may also be graduated to direct air from the intake conduit to a smaller diameter compressor intake. Guide vanes may also be provided within the flow device to control and direct air to the inlet of the turbocharger.

20 Claims, 3 Drawing Sheets

(56) References Cited

U.S. PATENT DOCUMENTS

| | | | | |
|---|---|---|---|---|
| 4,813,385 | A | 3/1989 | Yamaguchi et al. | |
| 4,890,444 | A | 1/1990 | Vander Giessen et al. | |
| 4,976,327 | A | 12/1990 | Abujudom et al. | |
| 5,031,712 | A | 7/1991 | Karolek et al. | |
| 5,304,351 | A | 4/1994 | Tanaka et al. | |
| 5,310,224 | A * | 5/1994 | Tenglund | 285/256 |
| 5,368,621 | A | 11/1994 | Pool | |
| 5,542,489 | A | 8/1996 | Allison et al. | |
| 5,683,478 | A | 11/1997 | Anonychuk | |
| 5,739,675 | A | 4/1998 | Green et al. | |
| 5,800,586 | A | 9/1998 | Cusick et al. | |
| 5,858,045 | A | 1/1999 | Stemmer et al. | |
| 5,865,863 | A | 2/1999 | DeSousa et al. | |
| 5,871,644 | A | 2/1999 | Simon et al. | |
| 5,874,052 | A | 2/1999 | Holland | |
| 5,921,214 | A | 7/1999 | Fujita et al. | |
| 5,922,096 | A | 7/1999 | Stemmer | |
| 6,152,096 | A | 11/2000 | Setsuda | |
| 6,152,996 | A | 11/2000 | Linnersten et al. | |
| 6,156,089 | A | 12/2000 | Stemmer et al. | |
| 6,162,271 | A | 12/2000 | Bullinger et al. | |
| 6,167,862 | B1 | 1/2001 | Powell et al. | |
| 6,178,939 | B1 | 1/2001 | Powell | |
| 6,230,833 | B1 | 5/2001 | Setsuda | |
| 6,231,646 | B1 | 5/2001 | Schweizer et al. | |
| 6,258,144 | B1 | 7/2001 | Huang | |
| 6,287,354 | B1 | 9/2001 | Nozaki | |
| 6,312,489 | B1 | 11/2001 | Ernst et al. | |
| 6,322,604 | B1 | 11/2001 | Midkiff | |
| 6,355,079 | B1 | 3/2002 | Sorvari et al. | |
| 6,364,921 | B1 | 4/2002 | Raether et al. | |
| 6,372,004 | B1 | 4/2002 | Schultink et al. | |
| 6,387,141 | B1 | 5/2002 | Hollingsworth et al. | |
| 6,475,255 | B1 | 11/2002 | Walker, Jr. | |
| 6,485,544 | B1 | 11/2002 | Ziske | |
| 6,521,011 | B1 | 2/2003 | Sundet et al. | |
| 6,540,806 | B2 | 4/2003 | Reinhold | |
| 6,632,271 | B2 | 10/2003 | Robertson et al. | |
| 6,705,272 | B2 | 3/2004 | Leipelt et al. | |
| 6,716,263 | B2 | 4/2004 | Inoue et al. | |
| 6,716,264 | B2 | 4/2004 | Onoda | |
| 6,732,712 | B2 * | 5/2004 | Klotz et al. | 123/470 |
| 6,755,169 | B2 * | 6/2004 | Storz | 123/184.21 |
| 6,811,588 | B2 | 11/2004 | Niakin et al. | |
| 6,825,136 | B2 | 11/2004 | Cook et al. | |
| 6,840,973 | B2 | 1/2005 | Kuji et al. | |
| 6,860,267 | B2 | 3/2005 | Capon et al. | |
| 6,884,274 | B2 | 4/2005 | Niakan et al. | |
| 6,892,713 | B2 | 5/2005 | Criddle et al. | |
| 6,902,598 | B2 | 6/2005 | Gunderson et al. | |
| 6,920,867 | B2 | 7/2005 | Cutts et al. | |
| 6,938,614 | B2 | 9/2005 | Criddle et al. | |
| 7,008,468 | B2 | 3/2006 | Ashe | |
| 7,093,589 | B2 | 8/2006 | Sorersen et al. | |
| 7,122,068 | B2 | 10/2006 | Tate et al. | |
| 7,152,633 | B2 | 12/2006 | White | |
| 7,347,883 | B2 | 3/2008 | Bajza et al. | |
| 7,415,956 | B1 * | 8/2008 | Prior | 123/184.53 |
| 7,537,645 | B2 | 5/2009 | Zambrano et al. | |
| 7,556,009 | B2 | 7/2009 | Niakan et al. | |
| 7,556,663 | B2 | 7/2009 | Niakan | |
| 7,645,329 | B2 | 1/2010 | Niakan et al. | |
| 8,083,822 | B2 * | 12/2011 | Hoffman et al. | 55/385.3 |
| 2001/0042361 | A1 | 11/2001 | Cox et al. | |
| 2002/0011051 | A1 | 1/2002 | Schultheib et al. | |
| 2003/0010002 | A1 | 1/2003 | Johnson et al. | |
| 2003/0080271 | A1 | 5/2003 | Haves | |
| 2004/0094115 | A1 | 5/2004 | Jatzke et al. | |
| 2005/0061292 | A1 | 3/2005 | Prellwitz et al. | |
| 2005/0076621 | A1 | 4/2005 | Chang | |
| 2005/0132682 | A1 | 6/2005 | Paul | |
| 2005/0208348 | A1 | 9/2005 | Canepa | |
| 2005/0210843 | A1 | 9/2005 | Bajza et al. | |
| 2005/0217625 | A1 | 10/2005 | Niaken et al. | |
| 2006/0107836 | A1 | 5/2006 | Maier et al. | |
| 2006/0260469 | A1 | 11/2006 | Miyagishima et al. | |
| 2008/0060524 | A1 | 3/2008 | Tumbrink et al. | |

* cited by examiner

AIR INTAKE FLOW DEVICE AND SYSTEM

FIELD OF THE INVENTION

The present invention is generally related to air intake flow devices and systems, and more particularly to a device which may be used to couple an air intake conduit having a first internal diameter to an air intake having a second, smaller, external diameter and to a system comprising selected components.

BACKGROUND ART

Relatively large internal diameter air intake kits are frequently used to increase the performance of existing internal combustions engines, such as those used in modern vehicles. The intake kits may have relatively larger internal diameters than original equipment manufacturer intakes to increase the volume of air delivered to the engine and to reduce pressure losses from the air filter to the engine's air intake or turbocharger inlet. While such air intakes may initially have intake conduits with larger internal diameters than corresponding original equipment manufacturer parts, they frequently taper down to mate with the engine's intake, such as a turbocharger, which may have an intake flange with a relatively smaller external diameter. For example, a turbocharger may have an air intake flange with an external diameter of approximately 2.875 inches. If the intake conduit has an initial internal diameter of 3.875 inches, such as where it mates to an air filter, that internal diameter will frequently reduce down to approximately 2.875" to mate with the intake flange of the turbocharger. When the diameter is shrunk from one end of the conduit to the next, air flow may be reduced, there may be undesirable steps in the conduit, and/or there may be flow inhibiting shapes present in the conduit. This may cause undesirable interruptions to the flow of intake air, undesirable pressure differentials, and may detrimentally impact performance. Further, it may be economically desirable for an air intake manufacturer to produce air intakes generally having a fixed configuration. Accordingly, the internal diameter of the portion of the air intake conduit that mates to a turbocharger of a particular vehicle may be too large for another vehicle. Further, when a manufacturer changes the intake flange dimensions of, for example, a turbocharger, a new intake conduit may need to be made to accept the newly-sized intake flange. It may therefore be prohibitively expensive for an air intake conduit manufacturer to constantly be retooling its products for only slightly different applications. Additionally, a coupler may need to be used to bridge the intake flange of the turbocharger with the intake conduit. The coupler may incorporate ridges therein which may further impede and/or disturb air flow. In addition, the coupler may need to be coupled on one side to the air intake conduit, and on the other side to the intake flange-necessitating two clamps to secure the air intake to the turbocharger. What is needed is an intake flow device configured to efficiently transfer air from an air intake conduit to an intake flange.

SUMMARY

Non-exclusive, non-limiting embodiments of the invention illustrated herein provide an intake flow device in the form of a collar having an inner surface with a first diameter, outer surface with a second diameter, and a graduated side surface for directing air flow. The flow device may be configured to fit onto a turbocharger's compressor intake flange or onto the intake flange of a normally-aspirated engine. The collar may be formed from a rubber-like material such as polyurethane, silicone, or other suitable materials designed to comply with, and effectively seal the engine's intake tract in the proximity of the intake opening, such as the turbocharger's compressor intake.

In application, the flexible collar may be placed over the intake flange of, for example, a turbocharger's compressor. The fit may be an interference fit such that the collar is positively located on the intake flange. As such, the outer diameter of the intake flange along its outer surface may be slightly larger than the internal diameter of the collar along its inner surface. The collar may also incorporate a recess along at least a portion of its inner surface. The recess may be configured to conform to a lip on the compressor's intake flange or to the end or another portion of the intake flange. Further more, an end of the collar opposite from the graduated end may be configured to lie flush with a side surface of the turbocharger's compressor. The combination of the snug interference fit, recess, and abutting arrangement may help the collar stay in place on the flange. A front portion of the collar, in some cases corresponding to portions of the graduation, may also drape over the intake flange such that there is a smooth, uninterrupted flow of air from the intake conduit to the compressor's blades.

The intake conduit may have an internal diameter generally corresponding to the outer diameter of the collar or slightly smaller than the outer diameter of the collar to form another interference fit. As such, one may place the intake conduit on the collar (already fitted to the intake flange) to seal the compressor's intake. Therefore, in some embodiments, the intake conduit may be formed with a relatively constant internal diameter, from end to end, that supports high air flow. Further, the intake conduit may be shaped and tuned for desired air flow characteristic such as increased throttle response and reduced lag in turbocharged applications. Such shaping and tuning may include, but is not limited to, varying the internal diameter, incorporating chambers, and creating different geometries in the intake conduit to support the desired air flow characteristics. A clamp or band may be used to tighten the conduit around the collar. The intake conduit may also incorporate openings around its diameter, such as slots, that, when tightened around the collar, compress to make a tight seal against the collar. The collar may also incorporate ribs on its outer surface capable of compressing when the intake conduit is fitted thereto, to increase the effectiveness of the seal. Further, the collar may incorporate flanges or vanes therein to direct air flow to the compressor wheel effectively. Said vanes may be configured in a variety of different fashions and may be straight or angled depending on application.

The collar may also be formed with a graduated front surface on one end such that air flowing from the intake conduit may smoothly transfer from the larger diameter of the intake conduit to the smaller diameter of the intake flange. This graduation may take different sizes and shapes depending on application. Such collars may be formed with different internal and external dimensions such that they can be capable of coupling different sized intake conduits to different sized intake flanges and may also be configured to work with naturally aspirated vehicles by mating to an intake flange of an engine's intake, rather than its compressor.

BRIEF DESCRIPTION OF THE DRAWINGS

The present invention is illustrated by way of example and not by limitation in the accompanying figures, in which like references indicate similar elements, and in which.

Skilled artisans appreciate that elements in the figures are illustrated for simplicity and clarity and have not necessarily been drawn to scale. For example, the dimensions of some of the elements in the figures may be exaggerated relative to other elements to help improve the understanding of the embodiments of the present invention.

DETAILED DESCRIPTION OF THE EMBODIMENTS

Figure 1:
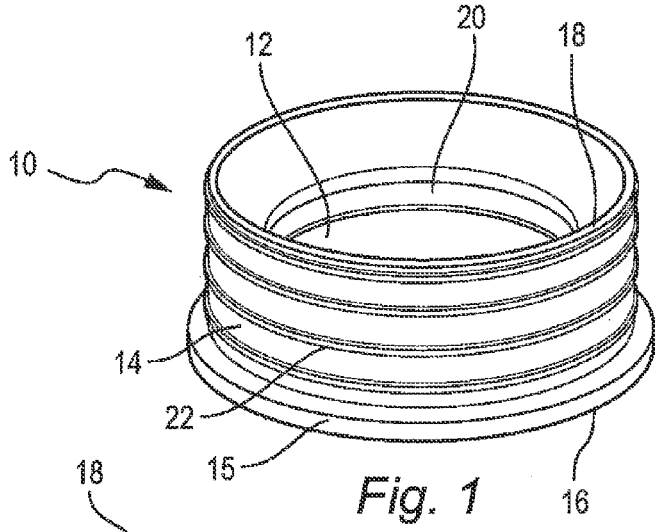
FIG. 1 is an illustration of a perspective view of an embodiment of an intake flow collar 10 in accordance with the teaching of the invention herein.
Figure 4:
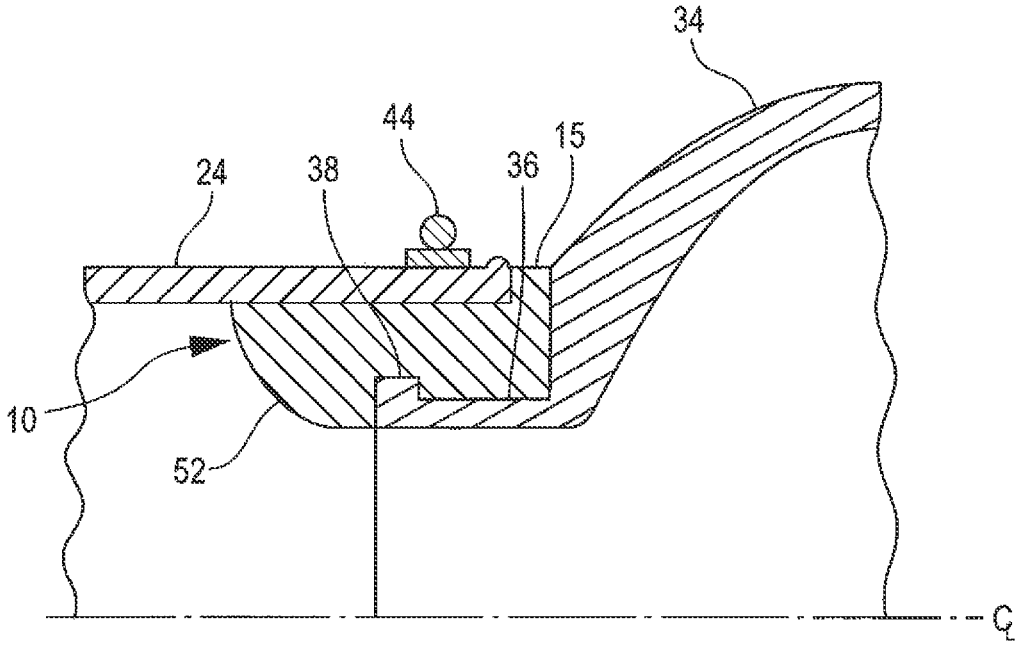
FIG. 4 is an illustration of a partial cross-sectional view of an embodiment of an intake flow collar 10 inserted into an air intake conduit 12 and onto an intake flange 36 of a turbocharger 34 in accordance with the teaching of the invention herein.

FIG. 1 illustrates a perspective view of an embodiment of an air intake flow device. The flow device may be in the form of a collar and may be made out a number of materials suitable for use in connection with an internal combustion engine. In this embodiment, collar 10 is formed from polyurethane, although in alternative embodiments the collar may be made from a number of additional materials such as silicone, rubber, and other materials suitable for a given application. As such, collar 10 is flexible and pliant and has material properties suitable for use in connection with under-hood heat generated from an internal combustion engine. Moreover, the polyurethane makes installation relatively easy as collar 10 may be pressed over a turbocharger's intake flange 36 and within an air intake conduit 24 (as shown in FIG. 4).

Figure 3:
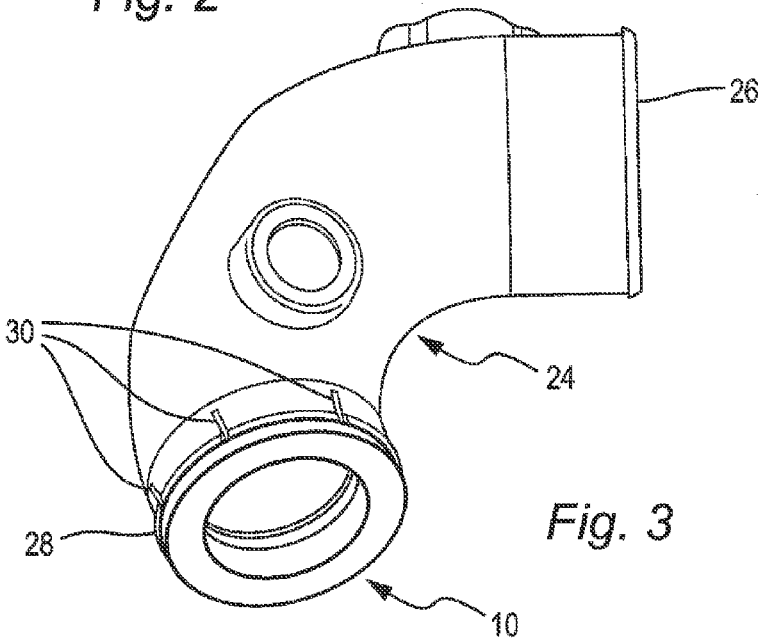
FIG. 3 is an illustration of a perspective view of an embodiment of an intake flow collar 10 inserted into an air intake conduit 12 in accordance with the teaching of the invention herein.

Collar 10 has an inner surface 12, outer surface 14, distal end 16, and proximal end 18. The inner surface 12 has an inner diameter that may be slightly smaller than the outer diameter of an intake flange that it may be mounted to. In particular, in the case of a turbocharger application, as shown in FIG. 4, the outer diameter of intake flange 36 may be slightly larger than the inner diameter of collar 10. The slight difference in diameter may provide for a desirable interference fit whereby the collar 10 may be held tightly about the intake flange 36. In addition, collar 10 may be formed with a recess 20 within its interior surface 12. Recess 20 may conform to a lip 38 on intake flange 36 and further function to hold collar 10 securely on the intake flange. Further, collar may incorporate a collar flange 15. As shown in FIGS. 3-4, collar flange 15 may rest flush with a proximal end 28 of an air intake conduit 24 on one side and a turbocharger's 34 compressor housing on the other side. This configuration may further secure the relationship of the intake conduit 24, collar 10, and turbocharger 34 from undesirable movement. For different applications, it may be desirable to form the collar in different forms, such as elliptical shapes. The elliptical form may be particularly useful in connection with coupling the air intake to a throttle body which may also have an elliptical configuration. Furthermore, the collar may be configured for an interference fit, or not, depending on application and may have no recess or more than one recess depending on application and may also incorporate a flange, or not, depending on application.

Figure 2:
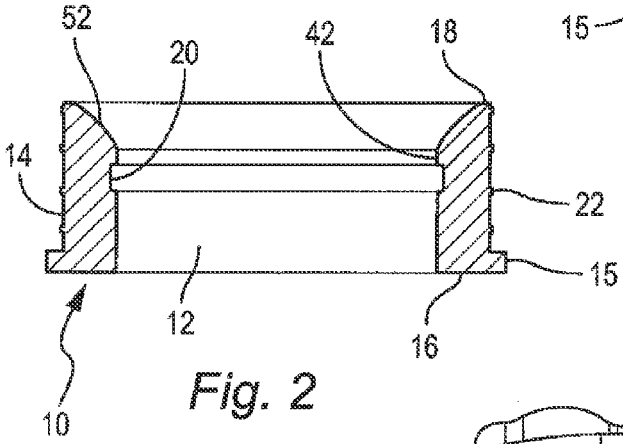
FIG. 2 is an illustration of a cross-sectional side view of an embodiment of an intake flow collar 10 in accordance with the teaching of the invention herein.

As shown in FIG. 2, collar 10 has a proximal end 18 with a graduated surface 52. The graduation, which may take numerous shapes, tends to direct air into the compressor's intake blades. Collar 10 may also be configured as shown herein to provide a smooth surface for air to flow from the graduation to the interior of intake flange 36. In particular, as shown in FIG. 4, a portion of collar 10, in this case corresponding to the graduated surface, may protrude over the intake flange 36 in the direction of incoming air. The inner diameter may be similar to, or the same as, the internal diameter of the intake flange 36. In this manner, the "step" between collar 10 and intake flange 36 may be reduced or eliminated.

Referring to FIGS. 1-2, collar 10 may be formed with one or more ribs 22 on its outer surface 14. Ribs 22 may be molded into collar 10 and made from the same material. In this embodiment, ribs 22 are configured to compress when air intake conduit 24 is fitted over collar 10, as shown in FIG. 3. The compression may be accomplished using devices such as an adjustable hose clamp 44 as illustrated in FIG. 4, though alternative means of securing are contemplated. In some cases, a clamp may not even be necessary depending on the relationship of the components. The compression of the ribs 22 helps to complete a seal along the intake tract. Similar to the interference fit arrangement of collar 10 and intake flange 36, air intake conduit 24 may be configured with a slightly smaller internal diameter than the outer diameter of the outer surface of collar 10. Accordingly, a tight seal may be formed when intake conduit 24 is clamped onto intake flange 36, around collar 10. Several slots 30 may be formed in air intake conduit 24 to help it compress under pressure. When clamp 44 is tightened, slots 30 may compress together, effectively shrinking the inner diameter of intake conduit 24.

FIG. 3 illustrates collar 10 within intake conduit 24. In this embodiment, intake conduit is formed from cross-linked polyethylene ("XLPE"), although in alternative embodiments, other materials including, but not limited to, aluminum, steel, and other plastics, metals, and composites may be used depending on application. As shown, the internal diameter of intake conduit is relatively constant from distal end 26 to proximal end 28. Dimensions of intake conduit 24 may be varied according to application. As set forth above, several slots 30 may be formed in air intake conduit 24 to help it compress under pressure such as when used in connection with a clamp 44 as shown in FIG. 4. Other well-known variations may be used to enable intake conduit 24 to compress according to application.

FIG. 4 illustrates collar 10 in connection with intake conduit 24 and turbocharger 34 as such devices may be coupled together. As shown, intake conduit 24 may be coupled to turbocharger 34 with only one clamp 44, rather than two clamps that may be used in connection with a conventional coupling. As such, there are fewer parts to assemble, tighten, and potentially come loose. In application, air will travel from an air filter, through intake conduit 24, through the graduated portion 52 of collar 10 into the turbocharger's 34 compressor intake flange 36, and thereafter be compressed by the turbocharger.

In the embodiment shown in FIGS. 1-4, the collar has an outer diameter of approximately 3.875 inches and an inner diameter of approximately 2.875 inches. Along inner surface 12, recess 20 has a diameter of approximately 3 inches and is approximately 0.25 inches wide and 0.125 inches deep. As set forth above, collar 10 has a proximal end 18 with a graduated surface 52 configured to direct air to the turbocharger. The graduation is approximately 0.625 inches wide, the graduation starting with a diameter of approximately 3.75 inches and tapering down to approximately 2.875 inches to correspond to the internal diameter of intake flange 36.

Figure 5:
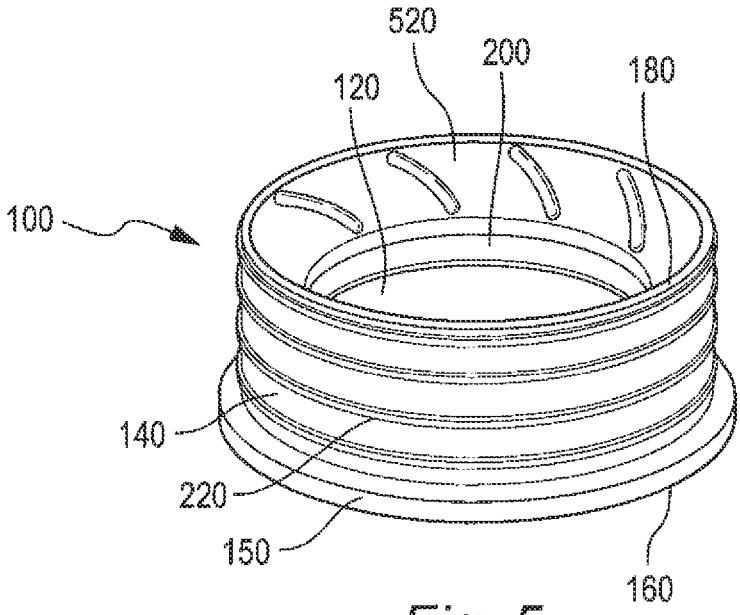
FIG. 5 is an illustration of a perspective view of an embodiment of an intake flow collar 100 in accordance with the teaching of the invention herein.

FIG. 5 illustrates an alternative collar 100 which may be formed with one or more vanes 170 for directing airflow into the intake. Similar to collar 10, collar 100 may have an inner surface 120, outer surface 140, distal end 160, and proximal end 180. The inner surface 120 may have an inner diameter that may be slightly smaller than the outer diameter of an intake flange that it may be mounted to. In addition, collar 100 may be formed with a recess 200 within its interior surface 120. For different applications, it may be desirable to form the collar in different forms, such as elliptical shapes. Collar 100 may have a proximal end 180 with a graduated surface 520 and may be formed with one or more ribs 220 on its outer surface 140.

Figure 6:
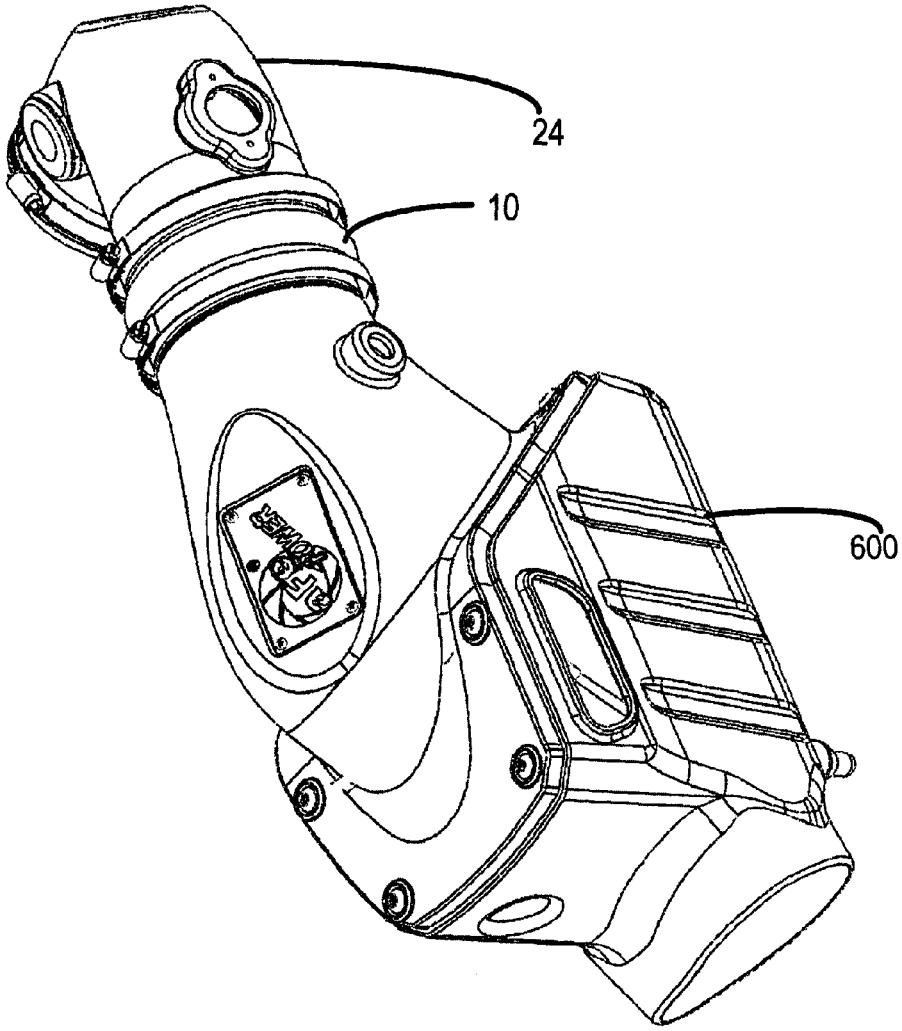
FIG. 6 is a perspective view of an air filtering device in accordance with the teaching of the invention herein.

FIG. 6 illustrates the elements of FIG. 1-4, or 5, coupled to air filtering device 600, as noted with respect to FIG. 4.

Benefits, other advantages, and solutions to problems have been described above with regard to specific embodiments. However, the benefits, advantages, solutions to problems, and any element(s) that may cause any benefit, advantage, or solution to occur or become more pronounced are not to be construed as a critical, required, or essential feature or element of any or all the claims. As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. The terms "a" or "an", as used herein, are defined as one, or more than one. The term "plurality", as used herein, is defined as two, or more than two. The term "another", as used herein, is defined as at least a second or more. The terms "including" and/or "having", as used herein, are defined as "comprising" (i.e., open language). The term "attached", as used herein, is defined as connected, although not necessarily directly.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention, as defined by the appended claims.

What is claimed is:

1. An air intake system comprising:

an air intake conduit having a proximal end and a distal end;

a pliant collar having an inner surface, a recessed portion along the inner surface, an outer surface, a graduated proximal end and a distal end;

a clamp for securing the air intake conduit to the collar;

wherein the distal end of the air intake conduit is formed to accept incoming air flow and convey said airflow downstream to the proximal end, the pliant collar outer surface is formed to fit within the proximal end of the air intake conduit, the pliant collar inner surface is formed to couple around an intake flange of a turbocharger, the pliant collar recessed portion is formed to mate to a corresponding portion of the intake flange, and the pliant collar graduated proximal end is formed to direct air to the turbocharger.

2. The air intake system of claim 1, wherein the collar further comprises one or more compressible ribs formed on its outer surface.

3. The air intake system of claim 1, wherein the air intake conduit further comprises slots formed in its proximal end so that the conduit can be compressed.

4. The air intake system of claim 1, wherein the distal end of the air intake conduit is coupled to an air filtering device.

5. The air intake system of claim 1, wherein the collar further comprises one or more vanes formed on the graduated proximal end.

6. The aft intake system of claim 1, wherein the collar is comprised of a material selected from the group consisting of polyurethane, silicone, and rubber.

7. The air intake system of claim 1, wherein the collar is generally cylindrically shaped.

8. The air intake system of claim 1, wherein a portion of the graduated proximal end has an internal diameter substantially equivalent to the inner diameter of the intake flange.

9. The air intake system of claim 1, wherein the collar recessed portion is formed to mate to a lip on the intake flange.

10. The air intake system of claim 1, wherein the collar distal end is formed to abut a portion of the turbocharger.

11. An air intake collar comprising:

an inner surface, a recessed portion along the inner surface, an outer surface, a graduated proximal portion, a distal end, and circumferentially arranged ribs;

wherein the inner surface is formed to conformingly couple around an intake flange of a turbocharger's compressor, the recessed portion is formed to mate to a corresponding portion of the intake flange, the outer surface is formed to fit within an air intake conduit, the graduated proximal end is formed to direct air to the turbocharger's compressor, and the ribs are formed to compress upon fitment of the intake conduit, wherein the air intake collar is pliant.

12. The air intake system of claim 11, wherein the collar further comprises one or more vanes formed on its graduated proximal portion.

13. The air intake system of claim 11, wherein the collar is comprised of a material selected from the group consisting of polyurethane, silicone, and rubber.

14. The air intake system of claim 11, wherein the collar is generally cylindrically shaped.

15. The air intake system of claim 11, wherein the collar is generally elliptically shaped.

16. The air intake system of claim 11, wherein a portion of the collar has an internal diameter substantially equivalent to the inner diameter of the intake flange.

17. A flexible, generally cylindrically-shaped air take flow device comprising:

an inner surface, a recessed portion along the inner surface, an outer surface, a graduated proximal end, a distal end, a flange, and circumferentially arranged ribs;

wherein the inner surface is formed to conformingly couple around an intake flange of a turbocharger's compressor, the recessed portion is formed to mate to a corresponding portion of the intake flange, the outer surface is formed to fit within an air intake conduit, the graduated proximal end is formed to direct air to the turbocharger's compressor, the flow device's flange longitudinally spaces the turbocharger from the air intake conduit, and the ribs are formed to compress upon fitment of the intake conduit.

18. The air intake system of claim 17, wherein the air intake flow device comprises one or more vanes formed internally.

19. The air intake system of claim 17, wherein the air intake flow device is comprised of a material selected from the group consisting of polyurethane, silicone, and rubber.

20. The air intake system of claim 17, wherein a portion of the collar has an internal diameter substantially equivalent to the inner diameter of the intake flange.

* * * * *